US010078929B1

(12) United States Patent
Chen

(10) Patent No.: US 10,078,929 B1
(45) Date of Patent: Sep. 18, 2018

(54) WIRELESS TRANSMISSION SYSTEM USED FOR A SELF-LOCKING LOCK BOX

(71) Applicant: Chung-Yu Chen, Taichung (TW)

(72) Inventor: Chung-Yu Chen, Taichung (TW)

( * ) Notice: Subject to any disclaimer, the term of this patent is extended or adjusted under 35 U.S.C. 154(b) by 0 days.

(21) Appl. No.: 15/801,984

(22) Filed: Nov. 2, 2017

(30) Foreign Application Priority Data

Oct. 13, 2017 (TW) ..... 106134991 A

(51) Int. Cl.

| | |
|---|---|
| ***G07C 9/00*** | (2006.01) |
| ***E05F 15/77*** | (2015.01) |
| ***E05C 3/22*** | (2006.01) |
| ***E05F 11/14*** | (2006.01) |

(52) U.S. Cl.
CPC ..... *G07C 9/00174* (2013.01); *E05C 3/22* (2013.01); *E05F 11/145* (2013.01); *E05F 15/77* (2015.01); *E05Y 2201/604* (2013.01); *E05Y 2400/45* (2013.01); *E05Y 2400/664* (2013.01); *E05Y 2900/132* (2013.01); *G07C 2009/00611* (2013.01); *G07C 2009/00634* (2013.01)

(58) Field of Classification Search
CPC ..... G07C 9/00103; G07C 9/00111; G07C 9/00309; G07C 9/00571; G07C 9/00126; G07C 9/00166; G07C 9/00007
USPC ..... 340/5.2
See application file for complete search history.

(56) References Cited

U.S. PATENT DOCUMENTS

2010/0188509 A1* 7/2010 Huh ..... G07C 9/00912 348/156
2015/0170447 A1* 6/2015 Buzhardt ..... H04N 7/186 348/143

* cited by examiner

*Primary Examiner* — Mark Blouin
(74) *Attorney, Agent, or Firm* — Ming Chow; Sinorica, LLC

(57) ABSTRACT

A wireless transmission system used for a self-locking lock box has a first transmission unit received in a first insert hole of a door frame, and a self-locking lock box secured at a door plank. The self-locking lock box is provided therein with a square bolt able to eject out of the lock box, and the square bolt is connected with a control pin and has its front end fixed with a second transmission unit. By so designing, when a user closes the door plank, the control pin will be pressed by the door frame and release the square bolt to make the square bolt eject out of the self-locking lock box and get into the first insert hole of the door frame, thus enabling the first transmission unit to approach the second transmission unit for elevating transmission efficiency.

9 Claims, 9 Drawing Sheets

WIRELESS TRANSMISSION SYSTEM USED FOR A SELF-LOCKING LOCK BOX

BACKGROUND OF THE INVENTION

1. Field of the Invention

This invention relates to a wireless transmission system used for a self-locking lock box.

2. Description of the Prior Art

A conventional electric control door is formed with a door plank and a door frame provided around the circumference of the door plank. The door frame is bored with a locking hole and the door plank is fixed with an electronic lock box, which is mounted therein with a lock bolt corresponding to the locking hole. Thus, the lock bolt can be controlled to be inserted in the locking hole to achieve the purpose of locking, or to be moved away from the locking hole to achieve the purpose of unlocking. In addition, for supplying the electronic lock box with electric power, the door plank is usually provided with a first coil device and the door frame is correspondingly provided with a second coil device for wirelessly transmitting electric power to the electronic lock box in a way of electromagnetic induction.

However, since a space between the door plank and door frame must be retrained so that the door plank can be pivotally rotated and moved about; therefore, there will be a space between the first coil device and the second coil device and this space will considerably reduce the transmission efficiency of electric power. Further, since every time when the door is closed, the door plank more or less will produce position deviation; therefore, the first coil device cannot easily be aligned to the second coil device and this situation will also influence transmission efficiency of electric power. Therefore, observing the above-mentioned drawbacks, the inventor of this invention thinks that the conventional wireless transmission system needs to be ameliorated and hence devises this invention.

BRIEF DESCRIPTION OF DRAWINGS

This invention will be better understood by referring to the accompanying drawings, wherein.

SUMMARY OF THE INVENTION

The objective of this invention is to offer a wireless transmission system used for a self-locking lock box. When a user closes a door plank, the wireless transmission system can function to actuate the square bolt of the self-locking lock box to eject out automatically and get into the first insert hole of a door frame to make a first transmission unit draw near to a second transmission unit for elevating transmission efficiency between coils.

The wireless transmission system used for a self-locking lock box in the present invention can be installed at a door body consisting of a door plank and a door frame assembled around circumference of the door plank. The door frame is bored with a first insert hole corresponding to the door plank, and the wireless transmission system contains a self-locking lock box secured at the door plank and formed with a housing, which is bored with a first through hole corresponding to the first insert hole. The first through hole is received therein with a slide square bolt, which is connected with a square bolt spring to let the square bolt have prestress to move out of the first through hole and the square bolt is provided with a stop part. The housing is formed with a control hole having a control pin sliding therein. The control pin can slide along the control hole to protrude out of the control hole to form a stop position and to retract back to the control hole to form a release position. When the control pin is at the stop position, the control pin will block the stop part, rendering the square bolt impossible to eject out of the first through hole, and when the control pin is at the release position, the control pin will get away from the stop part, permitting the square bolt to be elastically pushed by the square bolt spring and eject out of the first through hole. Further, the control pin is connected with a control spring to let the control pin have prestress to move toward the stop position. The first transmission unit of the wireless transmission system is received in the first insert hole of the door frame, formed with a first RFID coil facing outside of the opening the first insert hole and provided with a first control module electrically connected with the first RFID coil for controlling the first RFID coil. The second transmission unit is disposed at the front end of the square bolt and formed with a second RFID coil facing the first RFID coil and further provided with a second control module, which is electrically connected with the second RFID coil for controlling the second RFID coil.

DETAILED DESCRIPTION OF THE PREFERRED EMBODIMENT

Figure 1:
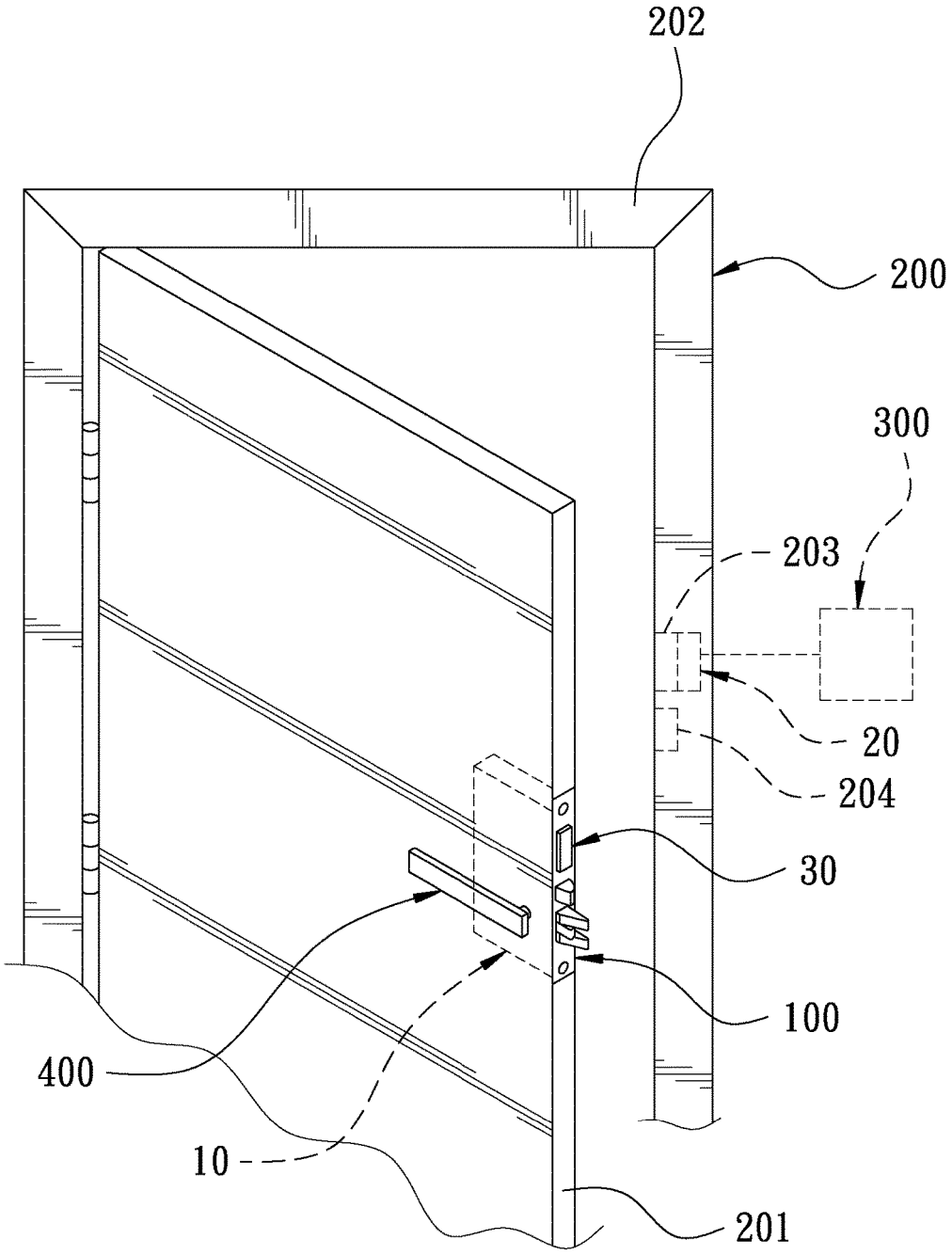
FIG. 1 is a schematic set-up diagram of a preferred embodiment of a wireless transmission system used for a self-locking lock box in the present invention.

A preferred embodiment of a wireless transmission system 100 used for a self-locking lock box in the present invention is mounted at a door body 200, as shown in FIG. 1. The door body 200 consists of a door plank 201 and a door frame 202 positioned around the circumference of the door plank 201. The door frame 202 is provided with a first insert hole 203 and a second insert hole 204 corresponding to the door plank 201. The wireless transmission system 100 contains a self-locking lock box 10 secured at the door plank 201, a first transmission unit 20 received in the first insert hole 203 and a second transmission unit 30 fixed with the self-locking lock box 10. The first transmission unit 20 is electrically connected with an external main engine 300, and the self-locking lock box 10 is connected with a handle 400.

Figure 2:
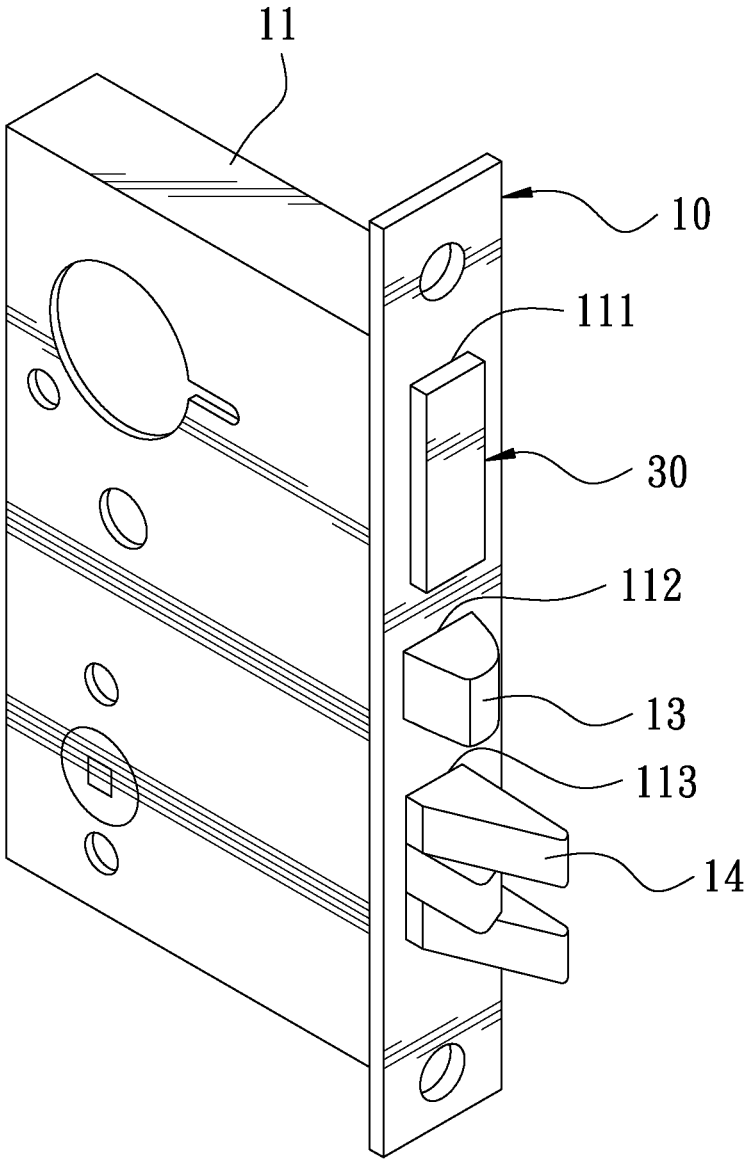
FIG. 2 is a perspective diagram of the preferred embodiment of a self-locking lock box in the present invention.
Figure 3:
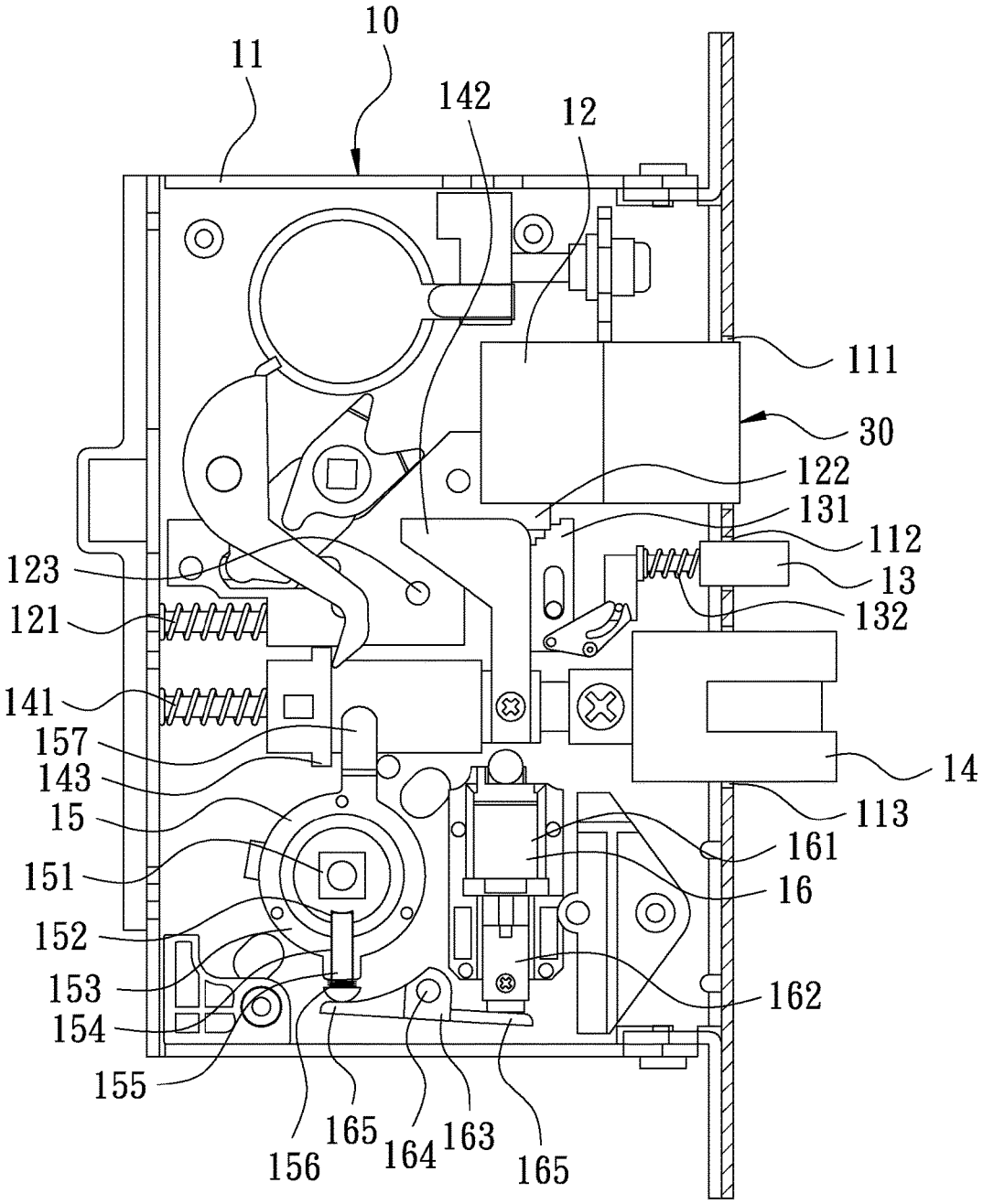
FIG. 3 is a cross-sectional diagram of the preferred embodiment of the wireless transmission system used for a self-locking lock box in the present invention.

Referring to FIGS. 2 and 3, the self-locking lock box 10 is formed with a housing 11, a square bolt 12, a control pin 13, an inclined bolt 14, an operating unit 15 and a drive unit 16.

The housing 11 is bored with a first through hole 11 corresponding to the first insert hole 203, a control hole located beneath the first through hole 111 and a second through hole 113 corresponding to the second insert hole 204.

The square bolt 12 is provided to slide in the first through hole 111 and connected with a square bolt spring 121, letting the square bolt 12 possess prestress to get out of the first through hole 111. Further, the square bolt 12 is provided with a stop part 122 and a convex part 123.

Figure 8:
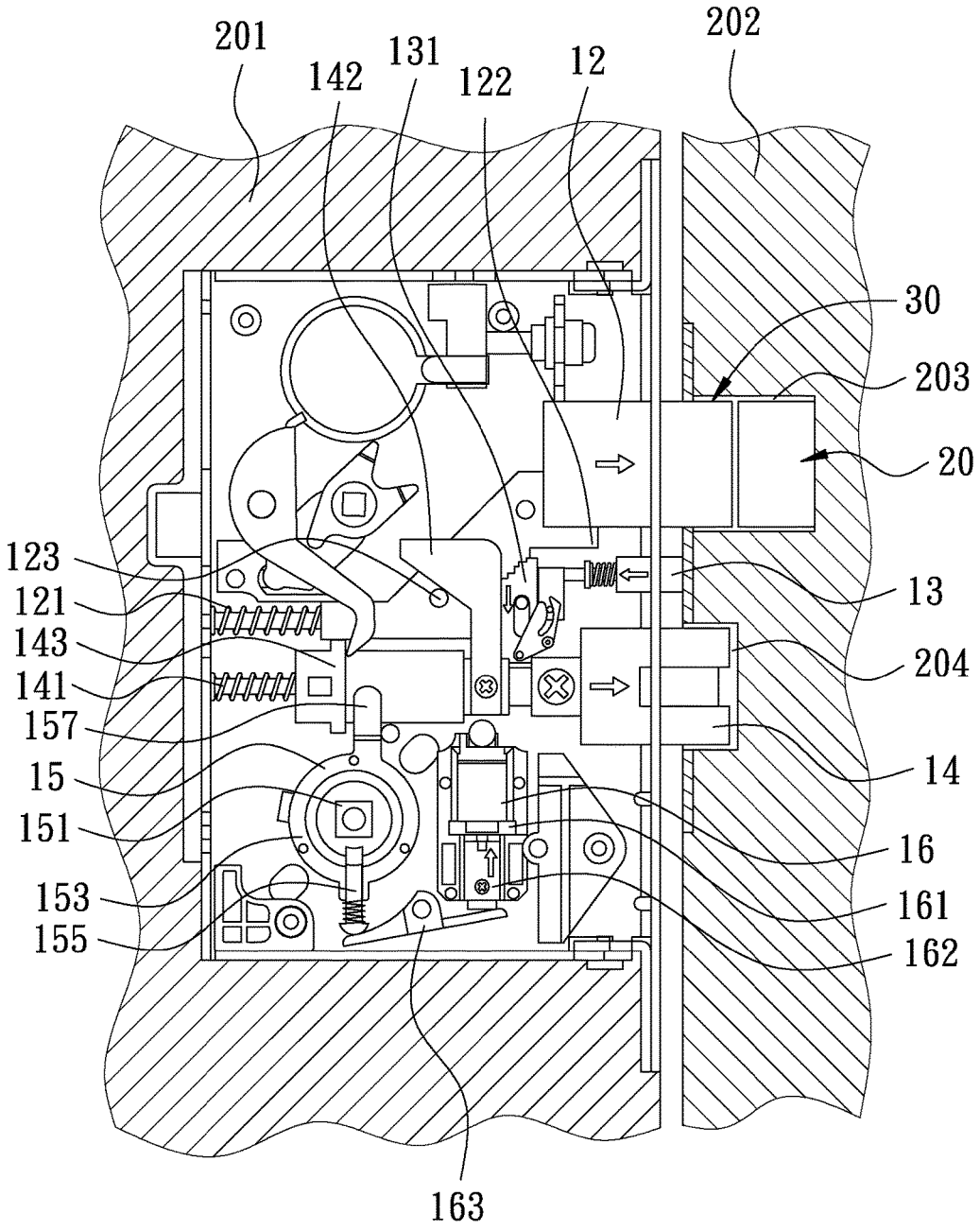
FIG. 8 is a schematic diagram of the preferred embodiment of the wireless transmission system used for a self-locking lock box in use in the present invention, showing a locking state.

The control pin 13 is provided to slide in the control hole 112 and connected with a link mechanism 131, able to slide along the control hole 112 to protrude out of the control hole 112 to form a stop position, as shown in FIG. 3 and to retract back to the control hole 112 to form a release position, as shown in FIG. 8. When the control pin 13 is at the stop position, the link mechanism 131 will block the stop part 122, rendering the square bolt 12 impossible to eject out of the first through hole 111, and when the control pin 13 is at the release position, the link mechanism 131 will get away from the stop part 122, enabling the square bolt 12 to be elastically pushed by the square bolt spring 121 to eject out of the first through hole 111. In addition, the control pin 13 is connected with a control spring 132, letting the control pin 13 have prestress to move toward the stop position.

The inclined bolt 14 able to slide is received in the second through hole 113 and connected with an inclined bolt spring 141, letting the inclined bolt 14 have prestress to get out of the second through hole 113. The inclined bolt 14 is provided with a hook part 142 for hooking the convex part 123 so that when the inclined bolt 14 is moved, the square bolt 12 can be actuated to move together. Further, the inclined bolt 14 is provided with a coupled part 143.

The operating unit 15 is received in the housing 11 and provided with a rotating shaft 151 able to rotate relative to the housing 11. The rotating shaft 151 is connected with the handle 400 shown in FIG. 1, so that the handle 400 can actuate the rotating shaft 151 to rotate. The rotating shaft 151 has its circumferential edge is disposed with a recessed connecting groove 152 and its outer side fitted with a shaft sleeve 153 able to rotate relative to the rotating shaft 151, and the shaft sleeve 153 is bored with a connecting hole 154 corresponding to the connecting groove 152 and provided with a slide pin 155 able to slide along the connecting hole 154 to form a joint position and a disengaging position. When the slide pin 155 is at the joint position, as shown in FIG. 3, the slide pin 155 is inserted in both the connecting hole 154 and the connecting groove 152 to enable the rotating shaft 151 to actuate the shaft sleeve 153 to rotate, and when the slide pin 155 is at the disengaging position, as shown in FIG. 8, the slide pin 155 is away from the connecting groove 152, and the rotating shaft 151 will run idle relative to the shaft sleeve 153 and will be impossible to actuate the shaft sleeve 153 to rotate. Further, the slide pin 15 is connected with a slide spring 156, letting the slide pin 155 have prestress to move toward the disengaging position. Moreover, the shaft sleeve 153 is provided with a force application part 157 connected with the coupled part 143 to enable the shaft sleeve 153 to actuate the inclined bolt 14 to shift.

The drive unit 16 is installed in the housing 11 and electrically connected with the second transmission unit 20, provided with an electric drive member 161 formed with a telescopic rod 162. The drive unit 16 further contains a driven member 163 formed with a pivot joint part 164, which is pivotally fixed with the housing 11. The pivot joint part 164 has two sides oppositely stretched outward to form two extension arms 165, which respectively press against the slide pin 155 and the telescopic rod 162. Thus, when the telescopic rod 162 is stretched outward, the driven member 163 will be pushed to press the slide pin 155 to be at the joint position, as shown in FIG. 3, and when the telescopic rod 162 is retracted back, the slide pin 155 will be at the disengaging position, as shown in FIG. 8.

Figure 4:
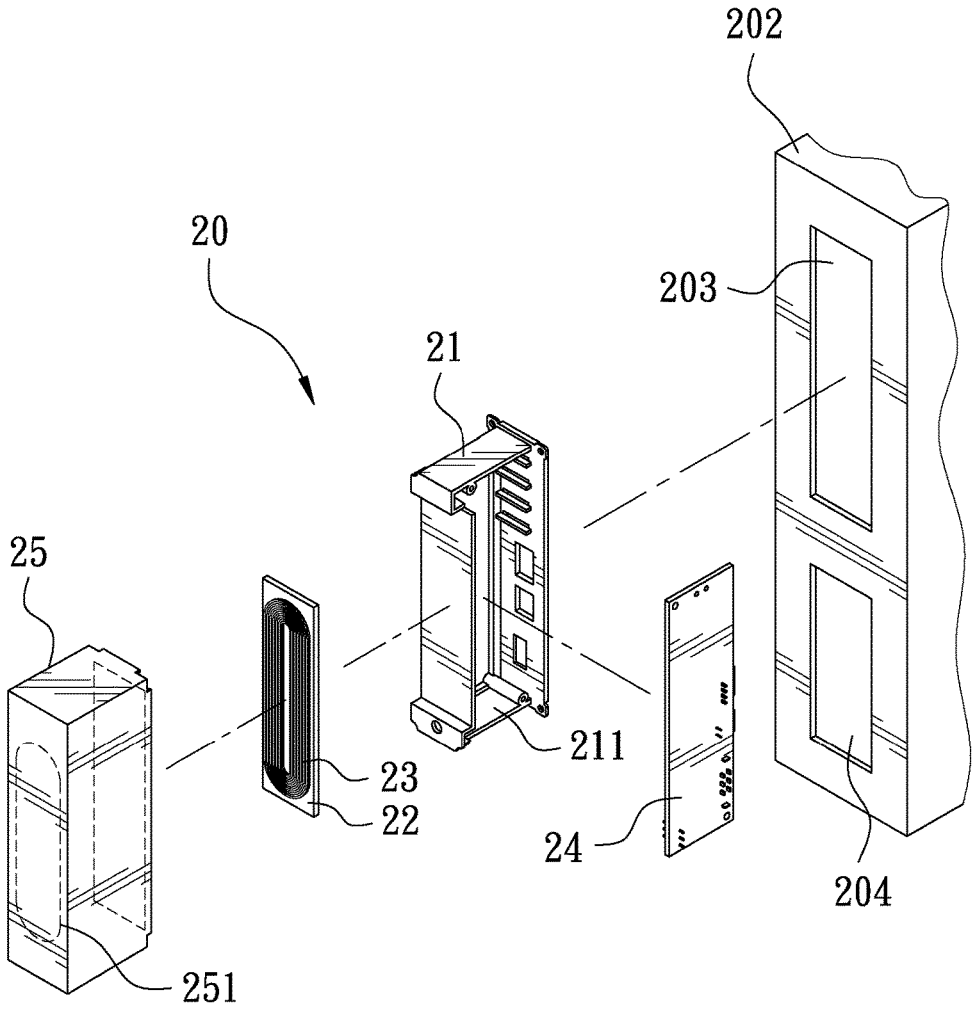
FIG. 4 is an exploded perspective diagram of a preferred embodiment of a first transmission unit in the present invention.
Figure 5:
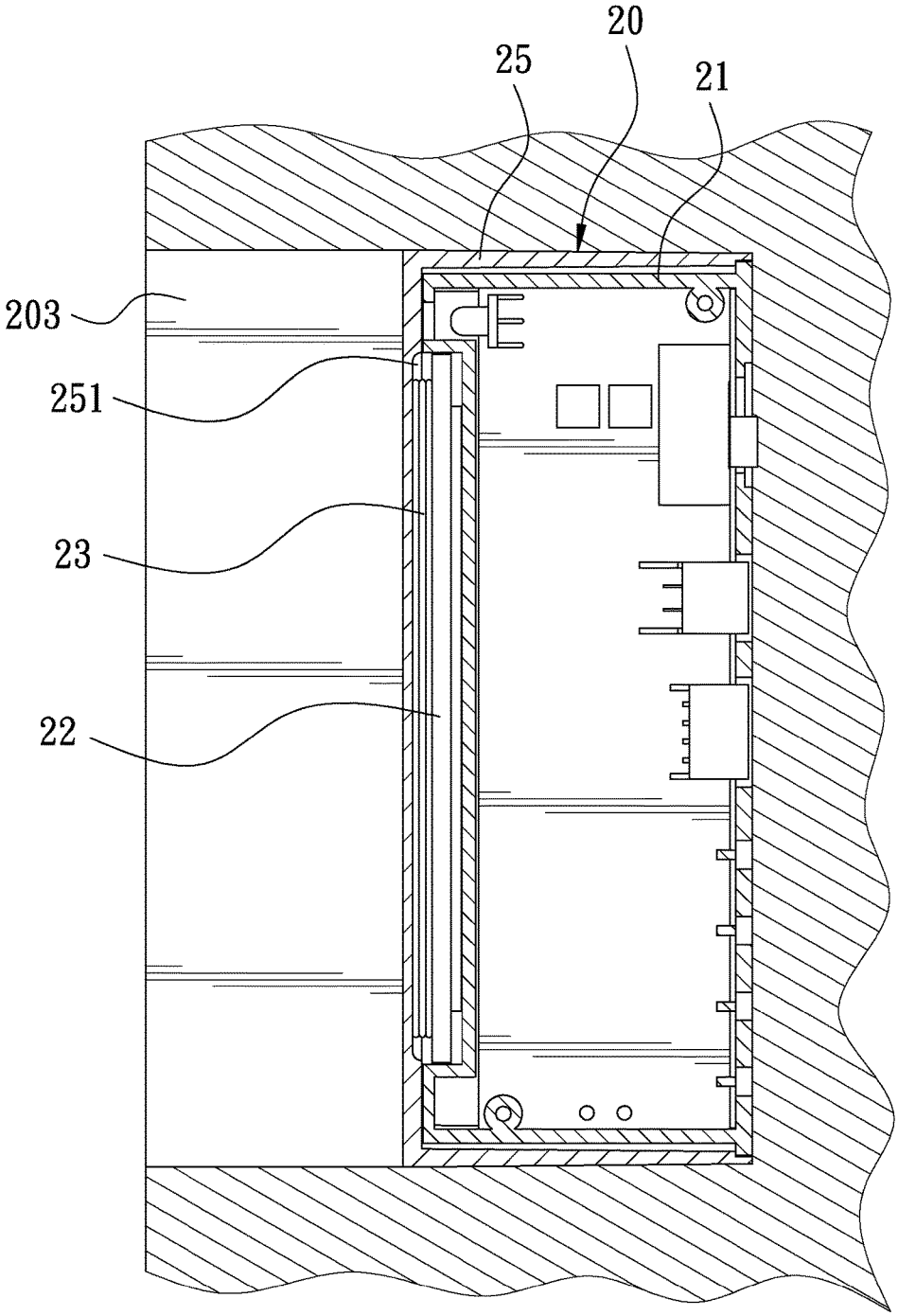
FIG. 5 is a cross-sectional diagram of the preferred embodiment of the first transmission unit in the present invention.

Referring to FIGS. 4 and 5, the first transmission unit 20 is received in the first insert hole 203 of the door frame 202, and provided with a first supporting seat 21, which is stuck with a first magnetic shield sheet 22 at one side facing outer side of the opening of the first insert hole 203, and the first magnetic shield sheet 22 has its outer side stuck with a first RFID coil 23. Further, the first supporting seat 21 is disposed with a recessed first accommodating groove 211 for receiving therein a first control module 24, which is electrically connected with the RFID coil 23 and able to control the first RFID coil 23. In addition, the first supporting seat 21 has its outer side covered with a first outer casing 25, which has an inner wall surface provided with a recessed first positioning groove 251 corresponding to the first RFID coil 23 for accommodating the first RFID coil 23 that protrudes out of the surface of the first supporting seat 21, letting the first RFID coil 23 provided as close as possible to the outer side.

Figure 6:
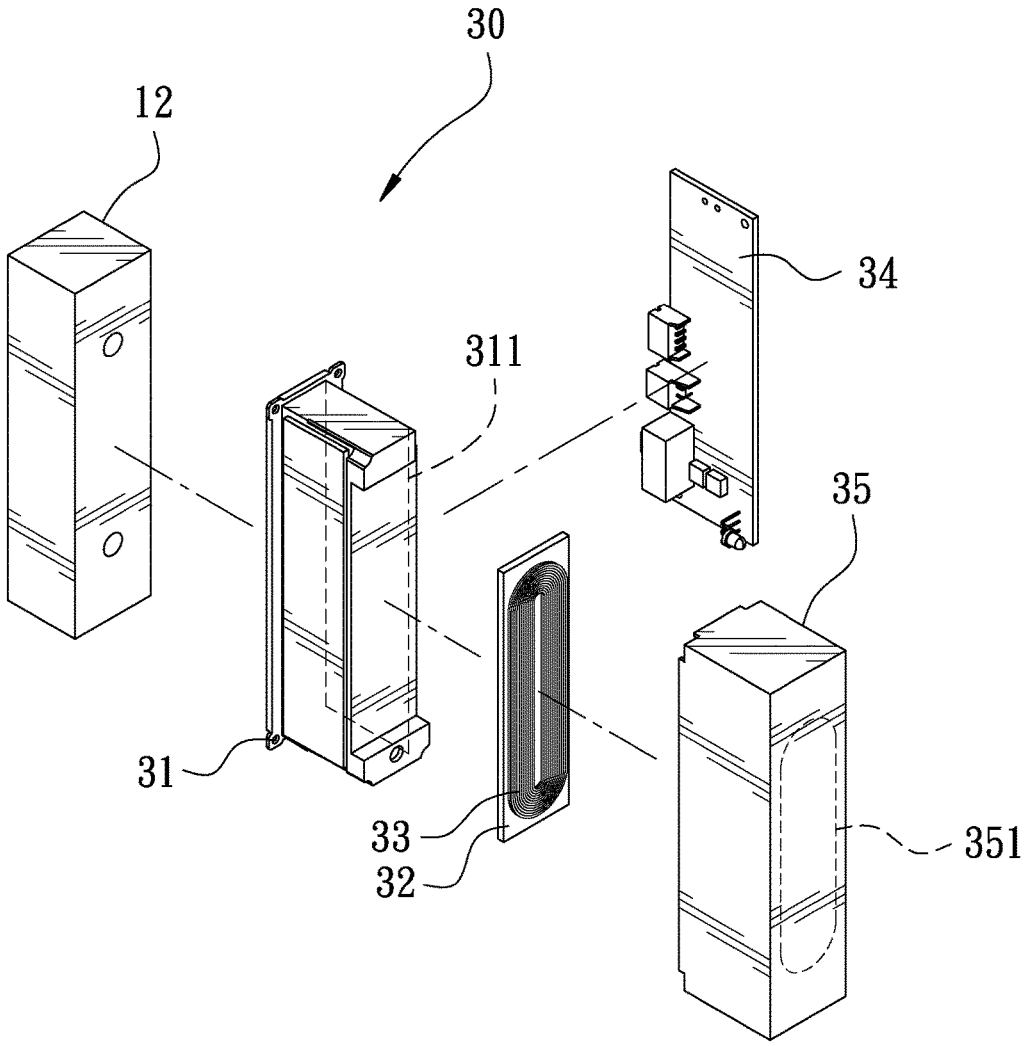
FIG. 6 is an exploded perspective diagram of a preferred embodiment of a second transmission unit in the present invention.
Figure 7:
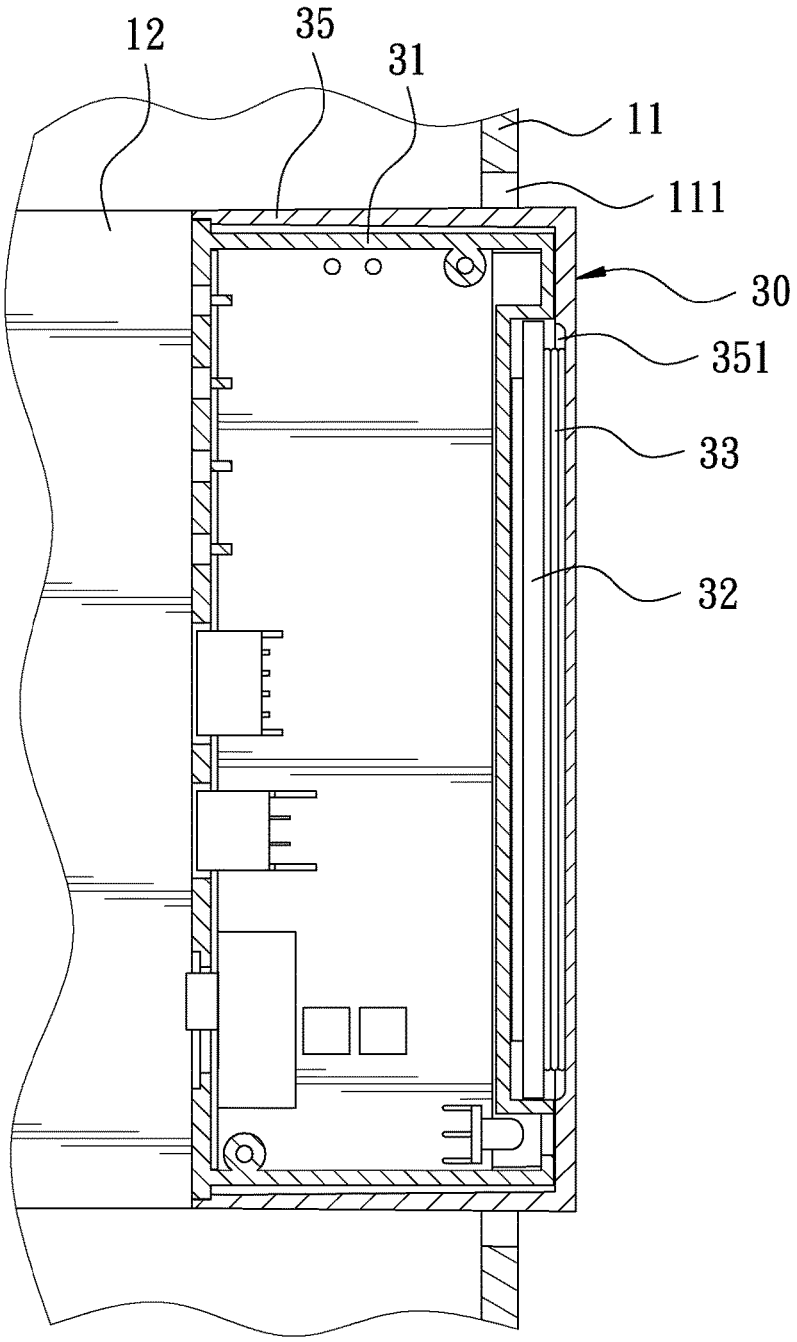
FIG. 7 is a cross-sectional diagram of the preferred embodiment of the second transmission unit in the present invention.

Referring to FIGS. 6 and 7, the second transmission unit 30 is set at the front end of the square bolt 12 and formed with a second supporting seat 31, which is pasted with a second magnetic shield sheet 32 at one side facing the first transmission unit 20, and the second magnetic shield sheet 32 has its outer side glued with a second RFID coil 33. The second supporting seat 31 is disposed with a recessed second accommodating groove 311 for receiving a second control module 34, which is electrically connected with the second RFID coil 33 and able to control the RFID coil 33. Furthermore, the second supporting seat 31 has its outer side covered with a second outer casing 35, which has its inner wall surface formed with a recessed second positioning groove 351 corresponding with the second RFID coil 33 for accommodating the second RFID coil 33 that protrudes out of the surface of the second supporting seat 31, letting the second REID coil 33 provided as close as possible to the outer side.

In use, referring to FIG. 8, when a user closes the door plank 201, the inclined bolt 14 will be elastically pushed by the inclined bolt spring 141 to protrude out of the second through hole 113 and get into the second insert hole 204 and meanwhile, the control pin 13 will be pressed by the door frame 202 to moved to the release position and get away from the stop part 122, permitting the square bolt 12 to be elastically pushed by the square bolt spring 121 to eject out of the first through hole 111 and get into the first insert hole 203 to let the second transmission unit 30 draw near to the first transmission unit 20. Thus, power source supplied by the external main engine 300 and control signals can be wirelessly transmitted to the second transmission unit 30 by the first transmission unit 20 in a way of electromagnetic induction so as to drive the electric drive member 161 to retract the telescopic rod 162, letting the slide pin 155 be at the disengaging position, and then, when a user turns the handle 400, the handle 400 will run idle, thus attaining the purpose of locking. That the second transmission unit 30 is fixed with the front end of the square bolt 12 enables the second transmission unit 30 to be inserted in the first insert hole 203 to approach the first transmission unit 20 when the square bolt 12 ejects out automatically, thus able to considerably shorten the distance between the first transmission unit 20 and the second transmission unit 30 and effectively align the first transmission unit 20 with the second transmission unit 30 for greatly elevating the transmission efficiency between the first RFID coil 23 and the second RFID coil 33. What is worthy of mentioning is that the first positioning groove 251 and the second positioning groove 351 are provided to enable the first RFID coil 23 and the second RFID coil 33 to be positioned as close as possible to the outer side for shortening the distance between the first RFID coil 23 and the second RFID coil 33 when the square bolt 12 ejects automatically.

Figure 9:
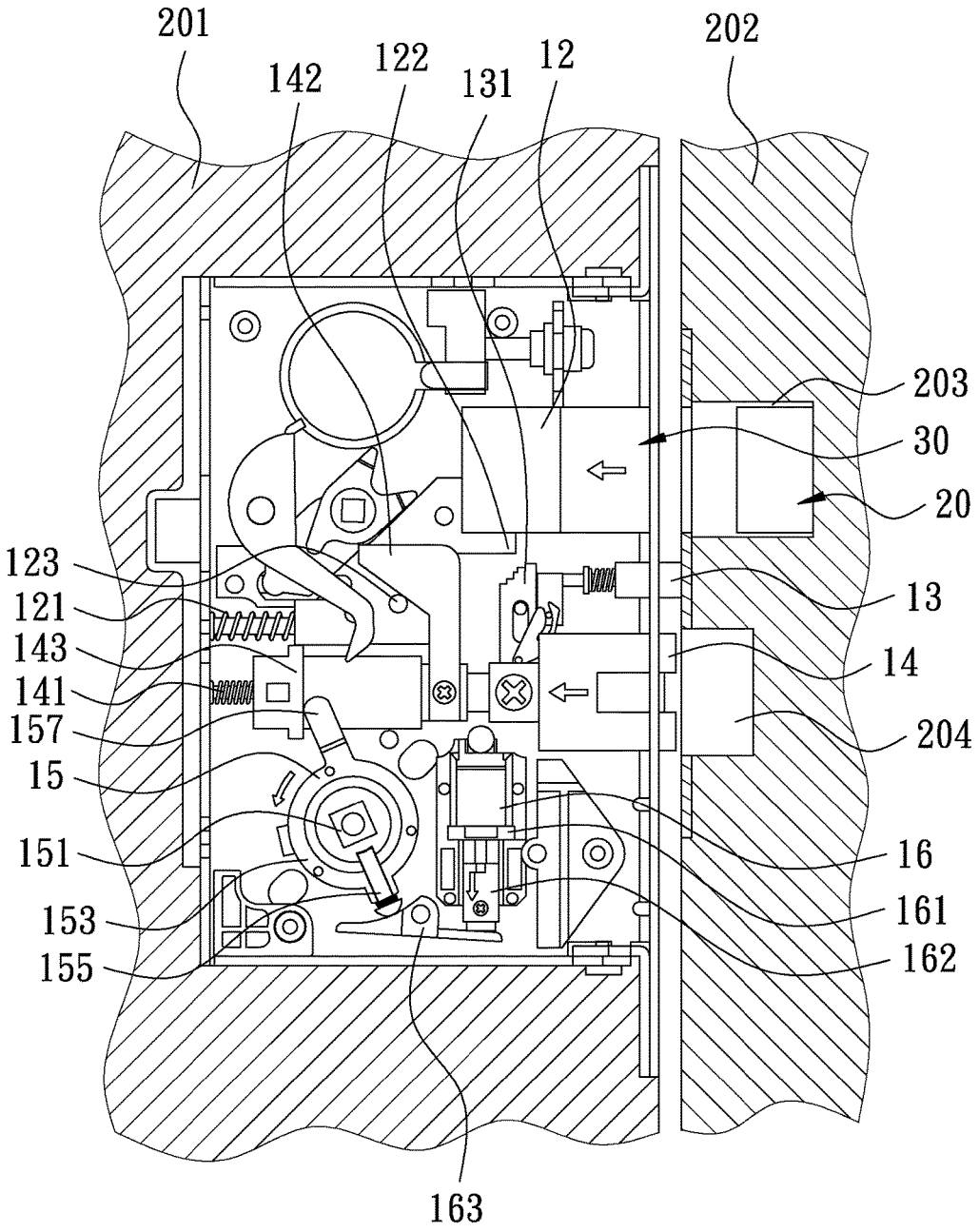
FIG. 9 is a schematic diagram of the preferred embodiment of the wireless transmission system used for a self-locking lock box in use in the present invention, showing an unlocking state.

Referring to FIG. 9, when an unlocking command of the external main engine 300 is transmitted to the second transmission unit 30 via the first transmission unit 20, the electric drive member 161 will stretch out the telescopic rod 162 to push against the driven member 163, letting the driven member 163 press the slide pin 155 to have the slide pin 155 located at the joint position. Thus, when a user turns the handle 400, the handle 400 will actuate the rotating shaft 151 to rotate together with the shafts sleeve 153 to let the force application part 157 pull the coupled part 143 to actuate the inclined bolt 14 to retract back to the second through hole 113 and synchronously, let the hook part 142 pull the convex part 123 to actuate the square bolt 12 to retract back to the first through hole 111, thus achieving the purpose of unlocking.

While the preferred embodiment of the invention has been described above, it will be recognized and understood that various modifications may be made therein and the appended claims are intended to cover all such modifications that may fall within the spirit and scope of the invention.

What is claimed is:

1. A wireless transmission system used for a self-locking lock box combined with a door body, said door body comprising a door plank and a door frame disposed at a circumference of said door plank, said door frame provided with a first insert hole corresponding to said door plank, said wireless transmission system comprising:

a self-locking lock box installed at said door plank and formed with a housing, said housing bored with a first through hole corresponding to said first insert hole, a square bolt sliding in said first through hole, said square bolt connected with a square bolt spring, letting said square bolt have prestress to move out of said first through hole, said square bolt formed with a stop part, said housing having a control hole, said control hole received therein with a sliding control pin, said control pin able to slide along said control hole, said control pin protruding out of said control hole to form a stop position, and retracting back to said control hole to form a release position, said control pin blocking said stop part to make said square bolt impossible to eject out of said first through hole when said control pin is at said stop position, said control pin getting away from said stop part to permit said square bolt to be elastically pushed by said square bolt spring and eject out of said first through hole when said control pin is at said release position, said control pin connected a control pin spring, letting said control pin have prestress to move toward said stop position;

a first transmission unit received in said first insert hole of said door frame, said first transmission unit provided with a first RFID coil facing outside of an opening of said first insert hole, said first transmission unit further provided with a control module, said control module electrically connected with said first RFID coil for controlling said first RFID coil; and a second transmission unit installed at a front end of said square bolt, said second transmission unit provided with a second RFID coil facing said first transmission unit, said second transmission unit disposed with a second control module, said second control module electrically connected with said second RFID coil for controlling said second RFID coil;

Thus, said control pin pressed by said door frame and shifted to said release position to get away from said stop part when a user closes said door plank, and then said square bolt elastically pushed by said square bolt spring to eject out of said first through hole and get into said first insert hole, thus enabling said first transmission unit to approach said second transmission unit to shorten a distance between said first RFID coil and said second RFID coil for elevating transmission efficiency between coils.

2. The wireless transmission system used for a self-locking lock box as claimed in claim 1, wherein said first transmission unit is formed with a first supporting seat, said first supporting seat having one side stuck with said first RFID coil to have said first RFID coil protruding out of the surface of said first supporting seat, said first supporting seat provided with a recessed first accommodating groove for receiving said first control module, said first supporting seat covered with a first outer casing, said first outer casing having an inner wall surface disposed with a recessed first positioning groove for receiving said first RFID coil that protrudes out of the surface of said first supporting seat.

3. The wireless transmission system used for a self-locking lock box as claimed in claim 2, wherein said first supporting seat has one side first stuck with a first magnetic shield sheet, and then said first magnetic shield sheet has an outer side stuck with said first RFID coil.

4. The wireless transmission system used for a self-locking lock box as claimed in claim 1, wherein said second transmission unit is formed with a second supporting seat, said second supporting seat having one side glued with said second RFID coil to have said second RFID coil protruding out of a surface of said second supporting seat, said second supporting seat provided with a recessed second accommodating groove for receiving said second control module, said second supporting seat covered with a second outer casing, said second outer casing having an inner wall surface bored with a second positioning groove corresponding to said second RFID coil for receiving said second RFID coil that protrudes out of a surface of said second supporting seat.

5. The wireless transmission system used for a self-locking lock box as claimed in claim 4, wherein said second supporting seat has one side first pasted with a second magnetic shield sheet, and then said second magnetic shield sheet has one outer side pasted with said second RFID coil.

6. The wireless transmission system used for a self-locking lock box as claimed in claim 1, wherein said control pin is connected with a link mechanism, said link mechanism blocking said stop part when said control pin is at said stop position, said link mechanism getting away from said stop part when said control pin is at said release position.

7. The wireless transmission system used for a self-locking lock box as claimed in claim 1, wherein said door frame is provided with a second insert hole , and said self-locking lock box is provided with a second through hole corresponding with said second insert hole, an inclined bolt mounted to slide in said second through hole, said inclined bolt connected with an inclined bolt spring, letting said inclined bolt have prestress to move out of said second through hole, said inclined bolt protruding out of said second through hole and get into said second insert hole when a user closes said door plank, said square bolt fixed with a convex part and said inclined bolt fixed with a hook part, said hook part able to clasp said convex part so that said inclined bolt able to actuate said square bolt to move together when said inclined bolt is shifted.

8. The wireless transmission system used for a self-locking lock box as claimed in claim 7, wherein said housing comprises an operating unit, said operating unit mounted in said housing, said operating unit provided with a rotating shaft able to rotate relative to said housing, said rotating shaft having a circumferential edge disposed with a recessed connecting groove, said rotating shaft having an outer side fitted with a shaft sleeve able to rotate relative to said rotating shaft, said shaft sleeve bored with a connecting hole corresponding to said connecting groove, said operating unit further formed with a slide pin, said slide pin provided to slide in said connecting hole, said slide pin able to slide along said connecting hole to form a joint position and an disengaging position, said slide pin inserted in both said connecting hole and connecting groove to enable said rotating shaft to actuate said shaft sleeve to rotate when said slide pin is at said joint position, said slide pin getting away from said connecting groove to disable said rotating shaft to actuate said shaft sleeve to rotate when said slide pin is at said disengaging position, said slide pin connected with a slide pin spring, letting said slide pin have prestress to move toward said disengaging position, said inclined bolt provided with a coupled part, and said shaft sleeve provided with a force application part, said force application part connected with said coupled part to enable said shaft sleeve to actuate said inclined bolt to shift.

9. The wireless transmission system used for a self-locking lock box as claimed in claim 8, wherein said housing further has a drive unit, said drive unit received in said housing and electrically connected with said second transmission unit, said drive unit formed with an electric drive member, said electric drive member formed with a telescopic rod, said drive unit comprising a driven member, said driven member formed with a pivot joint part, said pivot joint part pivotally fixed with said housing, said pivot joint part having two sides oppositely stretching outward to form two extension arms, said two extension arms respectively pressing against said slide pin and said telescopic rod.

* * * * *